US006097339A

United States Patent [19]

Filipovic et al.

[11] Patent Number: 6,097,339

[45] **Date of Patent: *Aug. 1, 2000**

[54] SUBSTRATE ANTENNA

[75] Inventors: Daniel F. Filipovic, Solana Beach; James L. Nybeck, San Diego, both of Calif.

[73] Assignee: QUALCOMM Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/028,510

[22] Filed: Feb. 23, 1998

[51] Int. Cl.[7] ..... H01Q 9/16

[52] U.S. Cl. ..... 343/702; 343/700 MS

[58] Field of Search ..... 343/702, 833, 343/834, 847, 848

[56] References Cited

U.S. PATENT DOCUMENTS

| | | | |
|---|---|---|---|
| 4,571,595 | 2/1986 | Phillips et al. | 343/745 |
| 4,814,776 | 3/1989 | Caci et al. | 343/702 |
| 5,072,230 | 12/1991 | Taniyoshi et al. | 343/715 |
| 5,394,160 | 2/1995 | Iwasaki et al. | 343/702 |
| 5,555,459 | 9/1996 | Kraus et al. | 343/702 |
| 5,642,120 | 6/1997 | Fujisawa | 343/702 |
| 5,650,790 | 7/1997 | Fukuchi et al. | 343/702 |
| 5,691,732 | 11/1997 | Tsuru et al. | 343/745 |
| 5,717,409 | 2/1998 | Garner et al. | 343/702 |
| 5,748,149 | 5/1998 | Kawahata | 343/700 MS |
| 5,821,903 | 10/1998 | Williams | 343/702 |

FOREIGN PATENT DOCUMENTS

| | | | |
|---|---|---|---|
| 0246026 | 11/1987 | European Pat. Off. | H01Q 1/24 |
| 5007109 | 1/1993 | European Pat. Off. | H01Q 9/42 |
| 0746054 | 5/1996 | European Pat. Off. | H01Q 1/24 |
| 0814535 | 6/1997 | European Pat. Off. | H01Q 9/04 |

*Primary Examiner*—Don Wong
*Assistant Examiner*—James Clinger
*Attorney, Agent, or Firm*—Philip R. Wadsworth; Gregory D. Ogrod; Charles D. Brown

[57] ABSTRACT

A substrate antenna that includes one or more conductive traces supported on a dielectric substrate having a predetermined thickness. Appropriate dimensions are selected for the lengths and widths of traces, based on the wavelength of interest, connecting elements, and space allocated. The supporting substrate is mounted offset from and generally perpendicular to the ground plane associate with the device with which the antenna is being used. The trace is electrically connected to a conductive pad on one end. A signal feed for the antenna is coupled to the conductive pad. The substrate antenna employs a very thin and compact structure to which provides appropriate bandwidth. Antenna compactness and a greater variety of useful shapes allow the substrate antenna to be used very efficiently as an internal antenna for wireless devices.

15 Claims, 13 Drawing Sheets

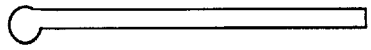
FIG. 7a
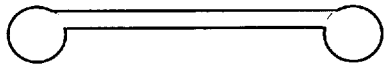
FIG. 7b
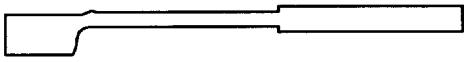
FIG. 7c
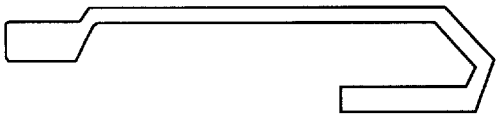
FIG. 7d
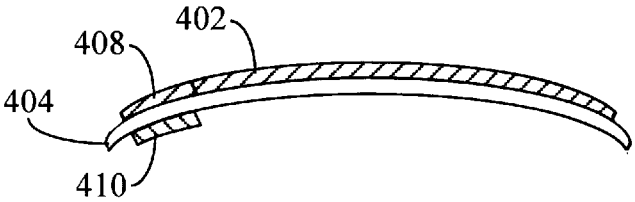
FIG. 7e
FIG. 7g
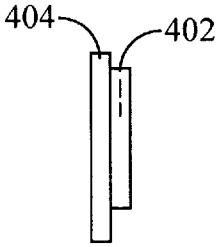
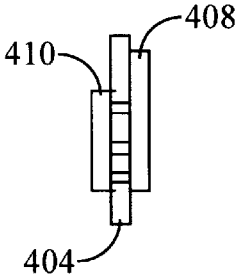
FIG. 7h
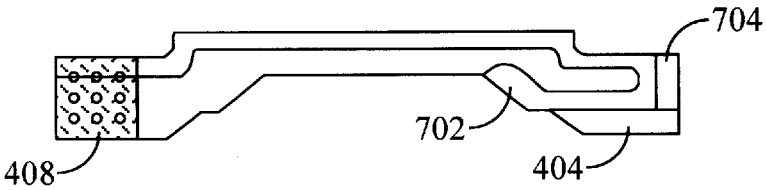
FIG. 7f

SUBSTRATE ANTENNA

BACKGROUND OF THE INVENTION

I. Field of the Invention

The present invention relates generally to antennas for wireless devices, and more particularly, to a substrate mounted antenna. The invention further relates to internal antennas for wireless devices, especially having improved dimensional, coupling, bandwidth, and radiation characteristics.

II. Description of the Related Art

Antennas are an important component of wireless communication devices and systems. Although antennas are available in numerous different shapes and sizes, they each operate according to the same basic electromagnetic principles. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with an increase in use of personal wireless communication devices, such as hand-held and mobile cellular and personal communication services (PCS) phones, the need for suitable small antennas for such communication devices has increased. Recent developments in integrated circuits and battery technology have enabled the size and weight of such communication devices to be reduced drastically over the past several years. One area in which a reduction in size is still desired is communication device antennas. This is due to the fact that the size of the antenna can play an important role in decreasing the size of the device. In addition, the antenna size and shape impacts device aesthetics and manufacturing costs.

One important factor to consider in designing antennas for wireless communication devices is the antenna radiation pattern. In a typical application, the communication device must be able to communicate with another such device or a base station, hub, or satellite which can be located in any number of directions from the device. Consequently, it is essential that the antennas for such wireless communication devices have an approximately omnidirectional radiation pattern, or a pattern that extends upward from a local horizon.

Another important factor to be considered in designing antennas for wireless communication devices is the antenna's bandwidth. For example, wireless devices such as phones used with PCS communication systems operate over a frequency band of 1.85–1.99 GHz, thus requiring a useful bandwidth of 7.29 percent. A phone for use with typical cellular communication systems operates over a frequency band of 824–894 MHz, which requires a bandwidth of 8.14 percent. Accordingly, antennas for use on these types of wireless communication devices must be designed to meet the appropriate bandwidth requirements, or communication signals are severely attenuated.

One type of antenna commonly used in wireless communication devices is the whip antenna, which is easily retracted into the device when not in use. There are, however, several disadvantages associated with the whip antenna. Often, the whip antenna is subject to damage by catching on objects, people, or surfaces when extended for use, or even when retracted. Even when the whip antenna is designed to be retractable in order to minimize such damage, it can extend across an entire dimension of the device and interfere with placement of advanced features and circuits within some portions of the device. It may also require a minimum device housing dimension when retracted that is larger than desired.

Whip antennas are often used in conjunction with short helical antennas which are activated when the whip is retracted into the phone. The helical antenna provides the same radiator length in a more compact space to maintain appropriate radiation coupling characteristics. While the helical antenna is much shorter, it still protrudes a substantial distance from the surface of the wireless device impacting aesthetics and catching on other objects. To position such an antenna internal to the wireless device would require a substantial volume, which is undesirable.

Another type of antenna which might appear suitable for use in wireless communication devices is a conformal antenna. Generally, conformal antennas follow the shape of the surface on which they are mounted and generally exhibit a very low profile. There are several different types of conformal antennas, such as patch, microstrip, and stripline antennas. Microstrip antennas, in particular, have recently been used in personal communication devices.

For example one type antenna which might appear suitable for use in wireless communication devices is an "inverted F" antenna. However, such antennas suffer from several drawbacks. They tend to be much larger than desired, suffer from lower bandwidth, and lack desirable omnidirectional radiation patterns.

As the term suggests, a microstrip antenna includes a patch or a microstrip element, which is also commonly referred to as a radiator patch. The length of the microstrip element is set in relation to the wavelength $\lambda_0$ associated with a resonant frequency $f_0$, which is selected to match the frequency of interest, such as 800 MHz or 1900 MHz. Commonly used lengths of microstrip elements are half wavelength ($\lambda_0/2$) and quarter wavelength ($\lambda_0/4$). Although, a few types of microstrip antennas have recently been used in wireless communication devices, further improvement is desired in several areas. One such area in which a further improvement is desired is a reduction in overall size. Another area in which significant improvement is required is in bandwidth. Current patch or microstrip antenna designs do not appear to obtain the desired 7.29 to 8.14 percent or more bandwidth characteristics desired for use in most communication systems, in a practical size.

Conventional patch and strip antennas have further problems when placed near the extensive ground planes found within most wireless devices. The ground planes can alter the resonant frequency, creating a non-repeatable manufactured design. In addition, "hand loading", that is, placement of a user's hand near the antenna dramatically shifts the resonant frequency and performance of the antenna.

Radiation patterns are extremely important not only for establishing a communication link as discussed above, but also in relation to government radiation standards for wireless device users. The radiation patterns must be controlled or adjusted so that a minimum amount of radiation can be absorbed by device users. There are governmental standards established for the amount of radiation that can be allowed near the wireless device user. One impact of these regulations is that internal antennas cannot be positioned in many locations within a wireless device because of theoretical radiation exposure for the user. However, as stated above, when using current antennas in other locations, ground planes and other structures often interfere with their effective use.

Therefore, a new antenna structure and technique for manufacturing antennas are needed to achieve internal wireless device antenna structures that have radiation patterns more commensurate with advanced radiation requirements for end users. At the same time, the antennas need to meet advanced communication system demands for bandwidth, and coupling efficiency, while being more conducive to internal mounting to provide more flexible component positioning within the wireless device, greatly improved aesthetics, and decreased antenna damage.

SUMMARY OF THE INVENTION

In view of the above and other problems found in the art relative to manufacturing internal antennas for wireless devices, one purpose of the present invention is to provide an antenna with decreased size and increased flexibility in mounting inside a wireless device.

A second purpose of the invention is to decrease the interaction between wireless device users and the antenna which otherwise degrades performance.

One advantage of the invention is that it provides a physically deformable support substrate allowing conformal mounting within the wireless device.

Other advantages include a reduction in manual labor and time to connect and install antennas within a wireless device, and a reduction in the number of cables and connectors required for this purpose.

These and other purposes, objects, and advantages are realized in a substrate antenna for use in wireless devices that includes one or more conductive traces supported on a dielectric substrate having a predetermined thickness. Appropriate dimensions are selected for trace length and width, based on wavelengths of interest for the wireless device, and space allocated. The supporting substrate is mounted offset from and generally perpendicular to a ground plane associated with circuits and components within the device, with which the antenna is being used. That is, the substrate is mounted adjacent to an edge of the ground plane and has a plane that is offset from the plane of the ground plane by less than 90 degrees. The substrate is not positioned directly over or under the ground plane.

The trace is electrically connected to a conductive pad on one end which interfaces with a signal feed for the antenna. Since a conductive pad is used, the signal feed comprises a conductive spring loaded, spring, or clip type device which makes electrical contact through pressure against the conductive pad. This allows automatic connection to the antenna without cables or manual installation of connectors and the like when the board is installed within the wireless device.

The substrate antenna employs a very thin and compact structure which provides appropriate bandwidth. Antenna compactness and a greater variety of useful shapes allow the substrate antenna to be used very efficiently as an internal antenna for wireless devices. It can be positioned advantageously within a device housing to take advantage of available space in spite of many possible interfering features or structures within the housing.

BRIEF DESCRIPTION OF THE DRAWINGS

The present invention is described with reference to the accompanying drawings, in which like reference numbers generally indicate identical, functionally similar, and/or structurally similar elements, the drawing in which an element first appears is indicated by the leftmost digit(s) in the reference number, and wherein:

FIG. 7*a*–7*h* illustrates several alternative embodiments of the present invention.

DETAILED DESCRIPTION OF THE PREFERRED EMBODIMENTS

Figure 1A:
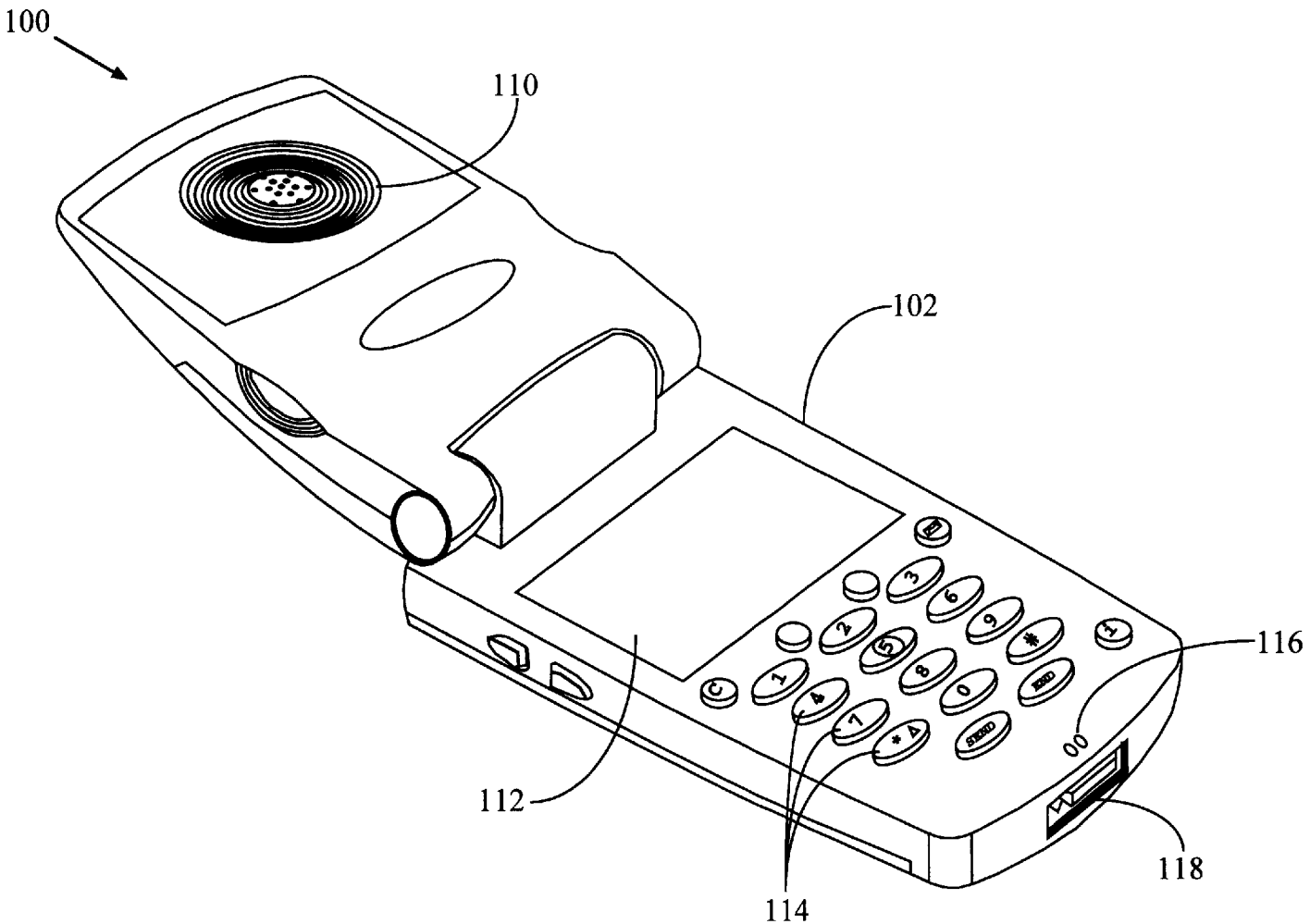
FIGS. 1*a* and 1*b* illustrate perspective and side views of a portable wireless telephone having a whip and an external helical antenna.

While a conventional microstrip antenna such as the inverted F antenna possesses some characteristics that make it potentially usable in personal communication devices, further improvement in other areas is still needed in order to make this type of antenna useful in wireless communication devices, such as cellular and PCS phones. One such area in which further improvement is desired is in bandwidth. Generally, PCS and cellular phones require a bandwidth greater than currently available with microstrip antennas, of practical size, in order to operate satisfactorily.

Another area in which further improvement is desired is the size of a microstrip antenna. For example, a reduction in the size of a microstrip antenna would make a wireless communication device in which it is used more compact and aesthetic. In fact, this might even determine whether or not such an antenna can be used in a wireless communication device at all. A reduction in the size of a conventional microstrip antenna is made possible by reducing the thickness of the dielectric substrate employed, or increasing the value of the dielectric constant, thereby shortening the necessary length. This, however, has the undesirable effect of reducing the antenna bandwidth, thereby making it less suitable for wireless communication devices.

Furthermore, the field pattern of conventional microstrip antennas, such as patch radiators, is typically directional. Most patch radiators radiate only in an upper hemisphere relative to a local horizon for the antenna. This pattern moves or rotates with movement of the device and can create undesirable nulls in coverage. Therefore, microstrip antennas have not been very desirable for use in many wireless communication devices.

The present invention provides a solution to the above and other problems. The present invention is directed to a substrate antenna that provides appropriate bandwidth and a reduction in size over other antenna designs while retaining other characteristics that are desirable for use in wireless communication devices. The substrate antenna of the present invention can be built near the top surface of a wireless or personal communication device such as a portable phone or may be mounted adjacent to or behind other elements such as support posts, I/O circuits, keypads, and so forth in the wireless device. The substrate antenna can also be built directly into, such as embedded within plastic forming a housing, or onto a surface of the wireless device.

Unlike either a whip or external helical antenna, the substrate antenna of the present invention is not susceptible to damage by catching on objects or surfaces. This antenna also does not consume interior space needed for advanced features and circuits, nor require large housing dimensions to accommodate when retracted. The substrate antenna of the present invention can be manufactured using automation and minimal manual labor, which decreases costs and increases reliability. Furthermore, the substrate antenna radiates a nearly omnidirectional pattern, which makes it suitable in many wireless communication devices.

In a broad sense, the invention can be implemented in any wireless device, such as a personal communication device, wireless telephones, wireless modems, facsimile devices, portable computers, pagers, message broadcast receivers, and so forth. One such environment is a portable or handheld wireless telephone, such as that used for cellular, PCS or other commercial communication services. A variety of such wireless telephones, with corresponding different housing shapes and styles, are known in the art.

FIGS. 1 and 2 illustrate typical wireless telephones which are used in wireless communication systems, such as the cellular and PCS systems discussed above. The phone illustrated in FIG. 1 (1*a* and 1*b*) is a "clam shell" shaped or folding body type phone, while the phone illustrated in FIG. 2 (2*a* and 2*b*) is a typical rectangular or "bar" shaped phone. These phones are typical of wireless telephones which are used in wireless communication systems, such as the cellular and PCS systems discussed above. These phones are used for purposes of illustration only, since there are a variety of wireless devices and phones, and associated physical configurations, including these and other types or styles, in which the present invention may be employed, as will be clear from the discussion below.

Figure 1B:
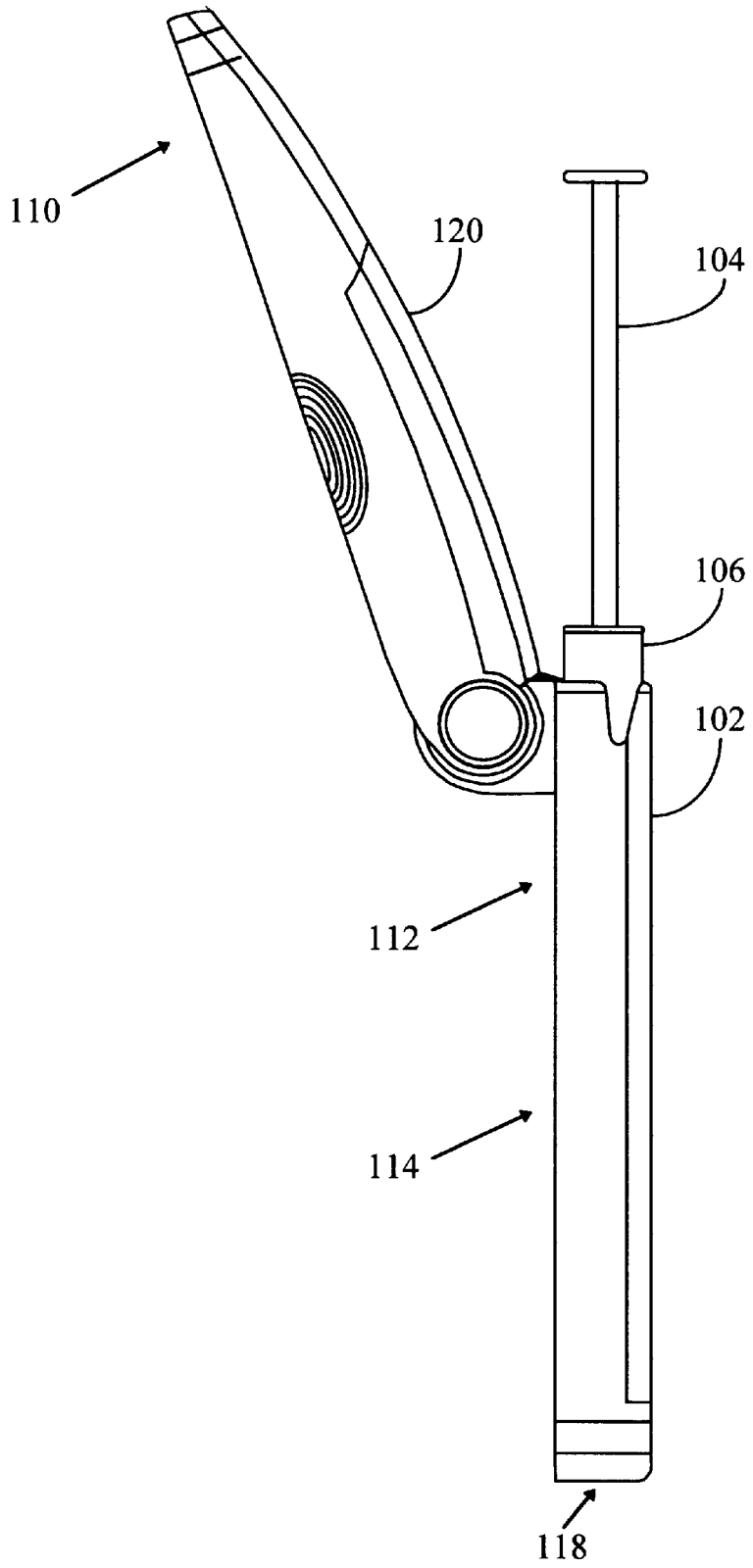

In FIGS. 1*a* and 1*b,* a phone 100 is shown having a main housing or body 102 supporting a whip antenna 104 and a helical antenna 106. Antenna 104 is generally mounted to share a common central axis with antenna 106, so that it extends or protrudes through the center of helical antenna 106 when extended, although this is not required for proper operation. These antennas are manufactured with lengths appropriate to the frequency of interest or of use for the particular wireless device on which they are used. Their specific design is well known and understood in the relevant art.

The front of housing 102 is also shown supporting a speaker 110, a display panel or screen 112, a keypad 114, and a microphone or microphone opening 116, and a connector 118. In FIG. 1*b,* antenna 104 is in an extended position typically encountered during wireless device use, while in FIG. 1*a* antenna 104 is shown retracted into housing 102.

Figure 2A:
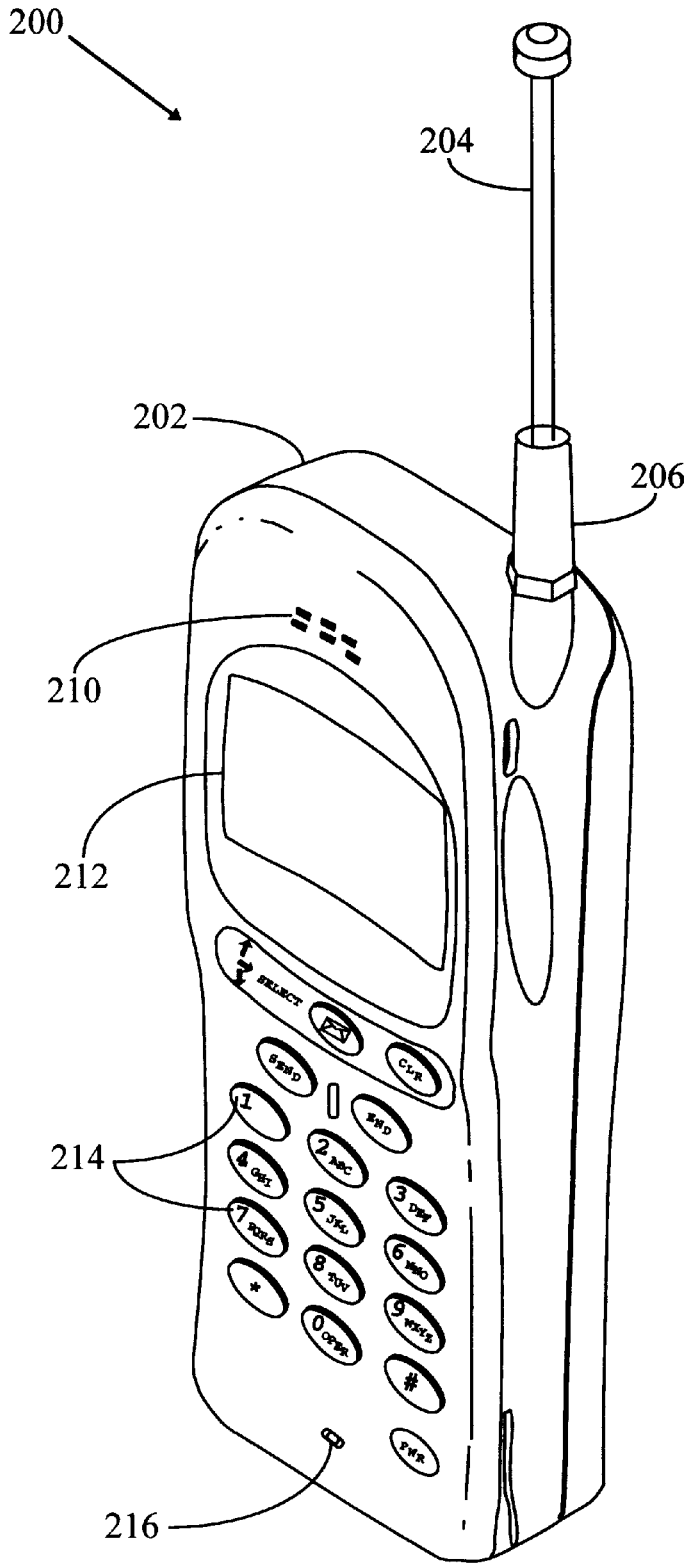
FIGS. 2*a* and 2*b* illustrate perspective and side views of another portable wireless telephone having a whip and an external helical antenna.
Figure 2B:
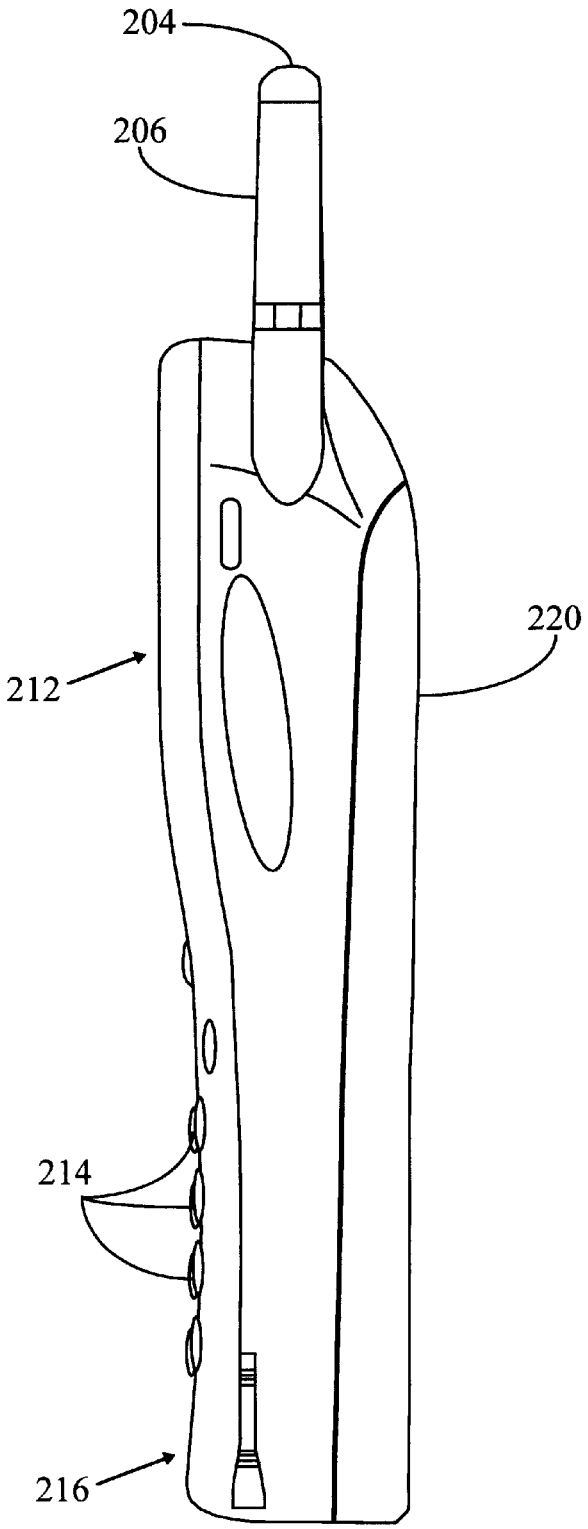

In FIGS. 2*a* and 2*b,* a phone 200 is shown having a main housing or body 202 supporting a whip antenna 204 and a helical antenna 206, in the same manner as seen for phone 100. The front of housing 200 is also shown supporting a speaker 210, a display panel or screen 212, a keypad 214, and a microphone or microphone opening 216. In FIG. 2*a* antenna 204 is shown in an extended position, while in FIG. 2*b* antenna 204 is shown retracted into housing 202.

As discussed above, whip antennas 104 and 204 have several disadvantages. One, is that they are subject to damage by catching on other items or surfaces when extended during use. Antennas 104 and 204 also consume interior space of the phone in such a manner as to make placement of components for advanced features and circuits, including power sources such as batteries, more restrictive and less flexible. In addition, antennas 104 and 204 may require minimum housing dimensions when retracted that are unacceptably large. Alternatively, antennas 104 and 204 could be configured with additional telescoping sections to reduce size when retracted, but would generally be perceived as less aesthetic, more flimsy or unstable, or less operational by consumers. Antennas 106 and 206 also suffer from catching on other items or surfaces during use, and cannot be retracted into phone housings 102 and 202, respectively.

The use of the present invention is described in terms of these exemplary wireless phones, for purposes of clarity and convenience only. It is not intended that the invention be limited to application in this example environment. After reading the following description, it will become apparent to a person skilled in the relevant art how to implement the invention in alternative environments. In fact, it will be clear that the present invention can be utilized in other wireless communications devices, such as, but not limited to, pagers, portable facsimile machines, portable computers with wireless communications capabilities, and so forth.

Figure 3A:
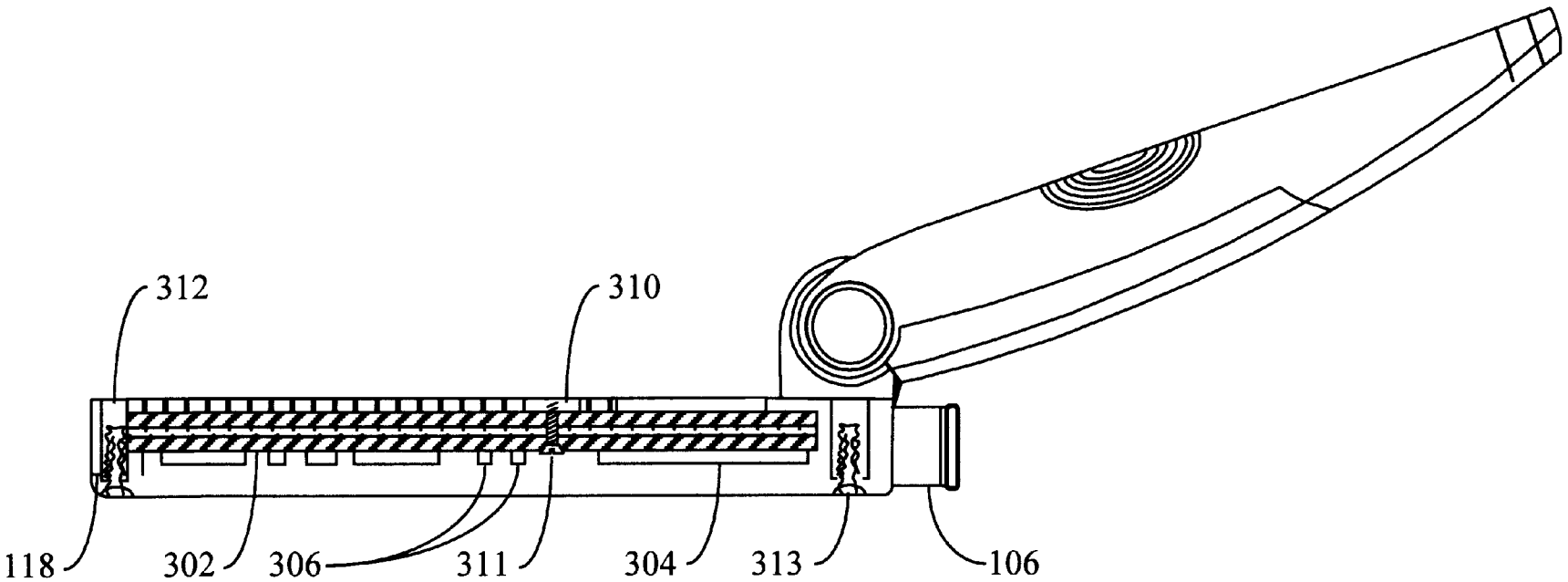
FIGS. 3*a* and 3*b* illustrate side and rear cross sectional views of the phone of FIG. 1*b* with exemplary internal circuitry.
Figure 3B:
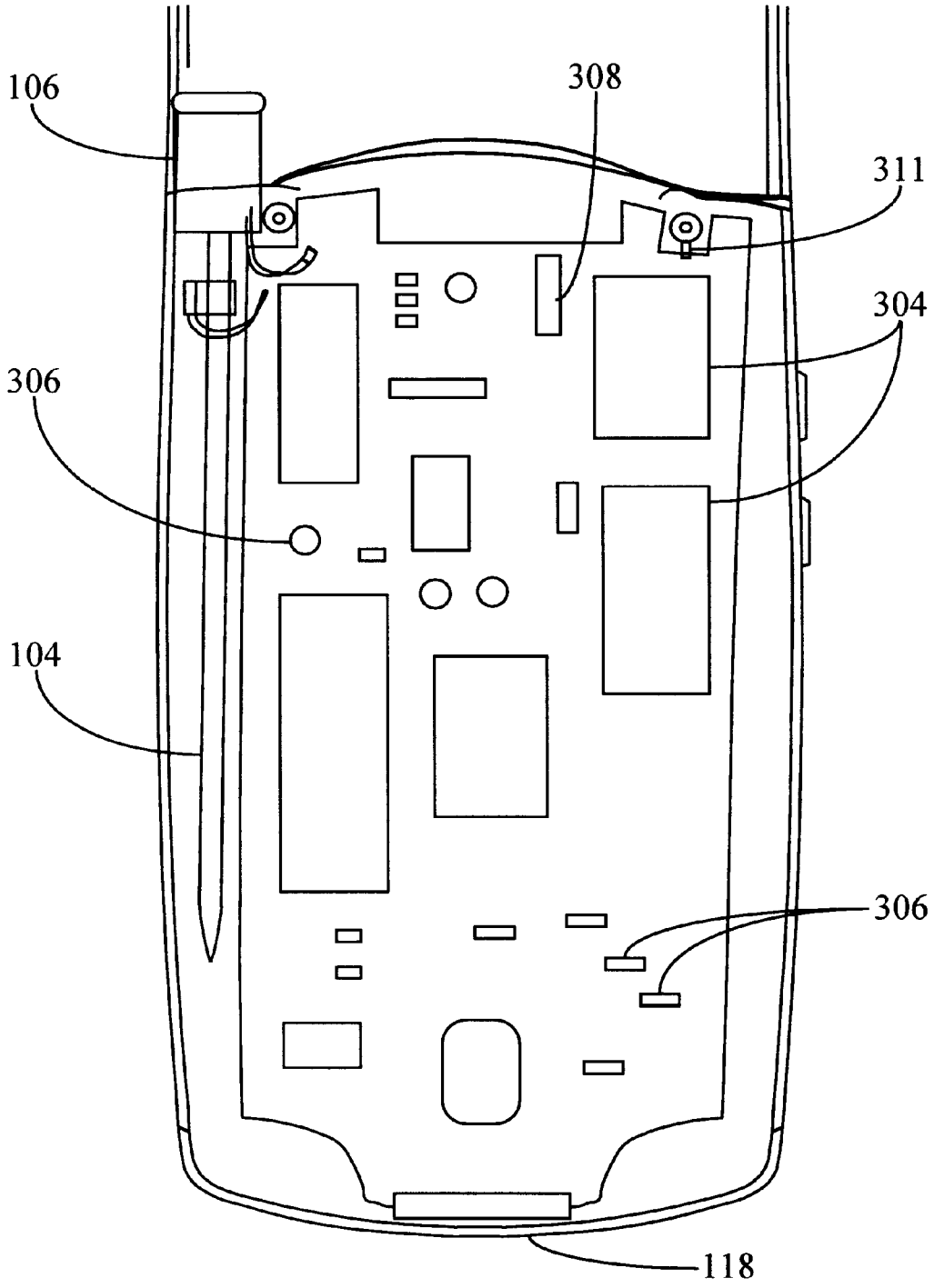
Figure 3C:
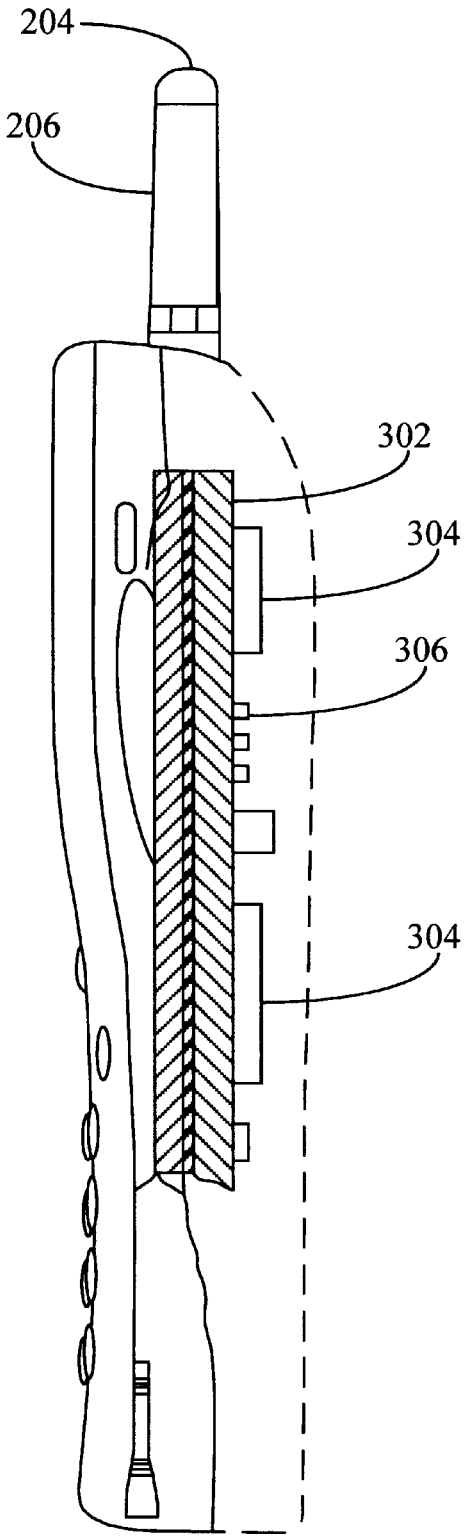
FIG. 3*c* illustrates a side cross sectional view of the phone of FIG. 2*b* with exemplary internal circuitry.

Each of these phones has various internal components generally supported on one or more circuit broads for performing the various functions needed. FIGS. 3*a,* 3*b,* and 3*c* are used to illustrate the general internal construction of a typical wireless phone. FIG. 3*a* illustrates a cross section of the phone shown in FIG. 1*b* when viewed from one side, to see how circuitry or components are supported within housing 102. FIG. 3*b* illustrates a cutaway of the same phone as viewed from the back, opposite side from the keypad, to see the relationship of the circuitry or components typically found within housing 102. FIG. 3*c* illustrates a cross section of the phone shown in FIG. 2*b* when viewed from one side.

In FIGS. 3*a* and 3*b,* a circuit board 302 is shown inside of housing 102 supporting various components such as integrated circuits or chips 304, discrete components 306, such as resistors and capacitors, and various connectors 308. The panel display and keyboard are typically mounted on the reverse side of board 302, which wires and connectors (not shown) interface the speaker, microphone, or other similar elements to the circuitry on board 302. Antennas 104 and 106 are positioned to one side and are connected to circuit board 302 using special wire connectors and clips intended for this purpose.

Typically, a predetermined number of support posts or stands 310 are used in housing 102 for mounting circuit boards or other components within the housing. One or more support ridges or ledges 311 can also be used to support circuit boards. These posts can be formed as part of the housing, such as when it is formed by injection molding plastic, or otherwise secured in place, such as by using adhesives or other well known mechanisms. In addition, there are typically one or more additional fastening posts 312 which are used to receive screws, bolts, or similar fasteners 313 to secure portions of housing 102 to each other. That is, housing 102 is manufactured using multiple parts or a main body portion and a cover over the electronics. Fastening posts 312 are then used to receive elements 313 to secure the housing portions together. The present invention easily accommodates or accounts for a variety of posts 310 or 312, while still providing a very efficient internal antenna design.

As seen in the enlarged view of FIG. 3*b,* circuit board 302 generally is manufactured as a multiple layer circuit board having several alternating layers of conductors and dielectric substrate bonded together to form a fairly complex circuit interconnection structure. Such boards are well known and understood in the art. As part of the overall structure, board 302 has at least one, and sometimes more, ground layer or ground plane, either on a bottom most surface or embedded within the board at an intermediate position.

Applicant has realized that it is the interaction of the antenna, either 104, 106, 204, or 206 with this ground plane that forms the radiation pattern for the wireless device. The antenna effectively excites the ground plane. That is, there are currents directed between the conductive material in the whip or helical antennas and the ground plane that creates the electromagnetic waves being launched into the air to form communication signals. It is also this combination that receives incoming signals being received by the wireless device. For this and other reasons Applicant has recognized that the larger less useful antennas can be replaced by a smaller more compact antenna element provided it is positioned appropriately with respect to the ground plane of the wireless device.

It is also noted that other attempts at creating internal antennas position the antenna radiator elements over the ground plane, especially where a certain amount of radiation shielding is desired. Unfortunately, this has the consequence of making it impossible to create a low-loss match to the antenna with sufficient operational bandwidth for normal cellular and PCS use. As a result such antennas are much less efficient and have lower gain, often decreasing in gain by about 6 dB or so.

Figure 4B:
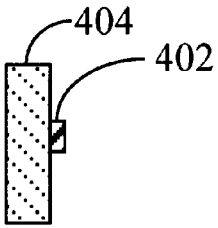
FIGS. 4*a*–4*c* illustrate a substrate antenna in accordance with one embodiment of the present invention.
Figure 4A:
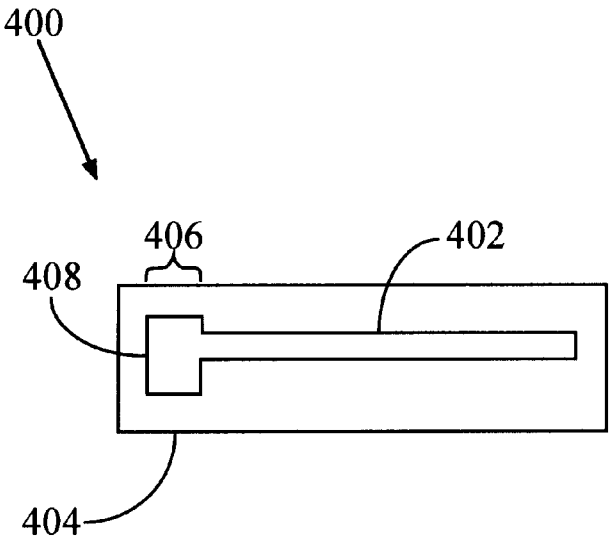
Figure 4C:
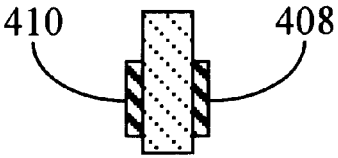

A substrate antenna 400 which is constructed and operating according to one embodiment of the present invention is shown beginning in FIGS. 4*a*–4*c*. In FIGS. 4*a* and 4*b*, substrate antenna 400 includes a conductive trace 402, also referred to as a strip or elongated conductor, a dielectric support substrate 404 and a signal feed region 406. Conductive trace 402 can be manufactured, or viewed, as more than one trace electrically connected together in series to form the desired antenna radiator structure. Trace 402 is electrically connected to a conductive pad 408 in signal feed region 406 at or adjacent to one end of substrate 404.

Substrate 404 is manufactured from a dielectric material or substrate, such as a circuit board or flexible material known for such uses. For example, a small fiberglass based printed circuit board (PCB) could be used. A variety of materials are available for manufacturing the substrate. Typical commercially available fiberglass, phenolic, plastic, or other printed circuit board or substrate materials can be used. The use of a thin substrate is not required, but provides the advantage of being deformable and easily mounted in place. A very thin Fiberglass reinforced Teflon sheet could be used for very thin substrates which are desired to meander or flex a significant amount. However, such thin material might not provide a rigid enough support to prevent the antenna characteristics from changing with movement of the phone. Those skilled in the art of electronics and antenna design are very familiar with the various products available from which to manufacture an appropriate antenna substrate, based on desired dielectric properties or antenna bandwidth characteristics.

The substrate acts as a means of support and spacing for the antenna radiator element, here the trace, from either other conducting surfaces, or to provide a minimal spacing from hands or other radiation absorbing or interactive material (such as tissue).

The trace is manufactured from a conductive material such as, for example, copper, brass, aluminum, silver or gold, or other conductive materials or compounds known to be useful in manufacturing antenna elements. This could include conductive materials embedded within plastic or conductive epoxies, which can also act as the substrate.

The trace, or traces, may be deposited using one of several known techniques such as, but not limited to, standard photo-etching of a conductive material on a dielectric or insulated substrate; plating or otherwise depositing a conductive material on a substrate; or positioning a conductive material, such as a thin plate of metal, on a support substrate using adhesives or the like. In addition, known coating or deposition techniques can be used to deposit metallic or conductive material on a plastic support element or substrate which can be shaped.

The length of trace 402 primarily determines the resonant frequency of substrate antenna 400. Trace 402, or a set or series of connected traces, is sized appropriately for a particular operating frequency. Traces used to comprise the antenna are deposited to provide a conductive element that is approximately ¼ an effective wavelength ($\lambda$) for the frequency of interest. Those skilled in the art will readily recognize the benefits of making the length slightly greater or less than $\lambda/4$, for purposes of matching the impedance to corresponding transmit or receive circuitry. In addition, connecting elements such as exposed cables, wires, or the clip discussed below contribute to the overall length of the antenna, and are taken into account when choosing the dimensions of traces, as is known.

Where substrate antenna 400 is used with a wireless device capable of communicating at more than one frequency, the length of trace 402 is based on the relationship of the frequencies. That is, multiple frequencies can be accommodated provided they are related by fractions of a wavelength. For example, the $\lambda/4$ length for one frequency corresponds to $3\lambda/4$ or $\lambda/2$ for the second frequency. Such relationships for using single radiators for multiple frequencies are well understood in the art.

The thickness of trace, or traces, 402 is usually on the order of a small fraction of the wavelength, in order to minimize or prevent transverse currents or modes, and to maintain a minimal antenna size (thickness). The selected value is based on the bandwidth over which the antenna must operate, as is known in the art of antenna design. The width of trace, or traces, 402 is also less than a wavelength in the dielectric substrate material, so that higher-order modes will not be excited.

The total length of trace 402 is approximately $\lambda/4$, but it should be noted that the trace can be folded, bent, or otherwise redirected, to extend back along the direction it came so that the overall antenna structure is much less than $\lambda/4$ in length. The thin conductor dimensions combined with a relatively thin support substrate and less than $\lambda/4$ total length, allows a significant reduction in the overall size of the antenna compared to conventional strip or patch antennas, thereby making it more desirable for use in personal communication devices. For example, compare these dimensions to the ground plane of a conventional microstrip antenna which is typically at least $\lambda/4$ in dimension in order to work properly.

As shown in FIGS. 4*a* and 4*c*, a conductive pad 408 is positioned in signal feed region 406 and electrically coupled or connected to trace 402. Generally, pad 408 and trace 402 are formed from the same material, possibly as a single unified body or structure, using the same manufacturing technique although this is not required. Pad 408 simply needs to make good electrical contact with trace 402 for purposes of signal transfer without adversely impacting antenna impedance or performance.

In some configurations, the trace will face a circuit board and signal sources or receivers, and in others it will face away from the board. In this latter situation, the substrate is positioned between the trace and the board. In this situation, conductive pad 408 would be positioned on the wrong side of the substrate for readily accepting a signal directly from a circuit board, without requiring a wire or other conductor to extend around the substrate. In many applications, this is undesirable as requiring a more complex connection and installation procedure. Therefore, as shown in FIG. 4*c,* a second contact pad 410 may be used on the opposing side of the substrate (as also seen in FIG. 5*a*) and conductive vias used to transfer signals through the substrate.

A signal transfer feed is coupled to substrate antenna 400 using pad 408 (and 410). The use of conductive pad 408 (and 410) allows the antenna to be installed and operated in a manner that provides for convenient electrical connection and signal transfer through "spring" type, or spring loaded, contacts or clips, which are known in the art. This simplifies construction and manufacture of the wireless device by eliminating a need for manual installation of specialized connectors, or having to manually insert the antenna within a contact structure. This type of electrical connection also means the antenna is conveniently replaceable when needed, either for repair or for upgrade or alteration of the wireless device to another frequency, without requiring de-soldering, or working with special connectors, and so forth. As discussed above, the spring contact contributes to the overall length of the antenna or antenna radiator (trace), and is to be taken into account when choosing the dimensions of traces.

The signal feed couples a signal from a signal processing unit or circuitry (not specifically shown) on circuit board 302 to substrate antenna 400. Note that the "circuitry" is used to refer generally to the functions provided by known signal processing circuits including receivers, transmitters, amplifiers, filters, transceivers, and so forth, all of which are 10 well known in the art.

Figure 5A:
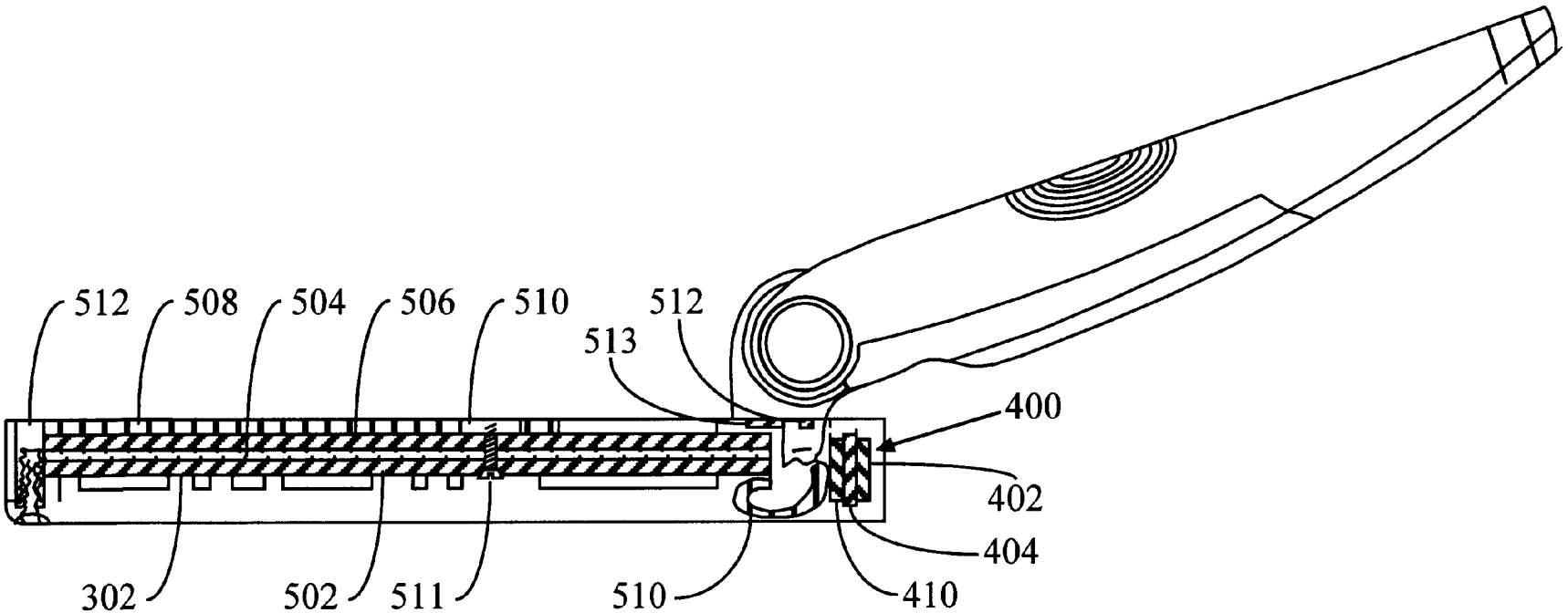
FIGS. 5*a* and 5*b* illustrate side cross sectional and rear views of the phone of FIG. 1*b* using the present invention.
Figure 5B:
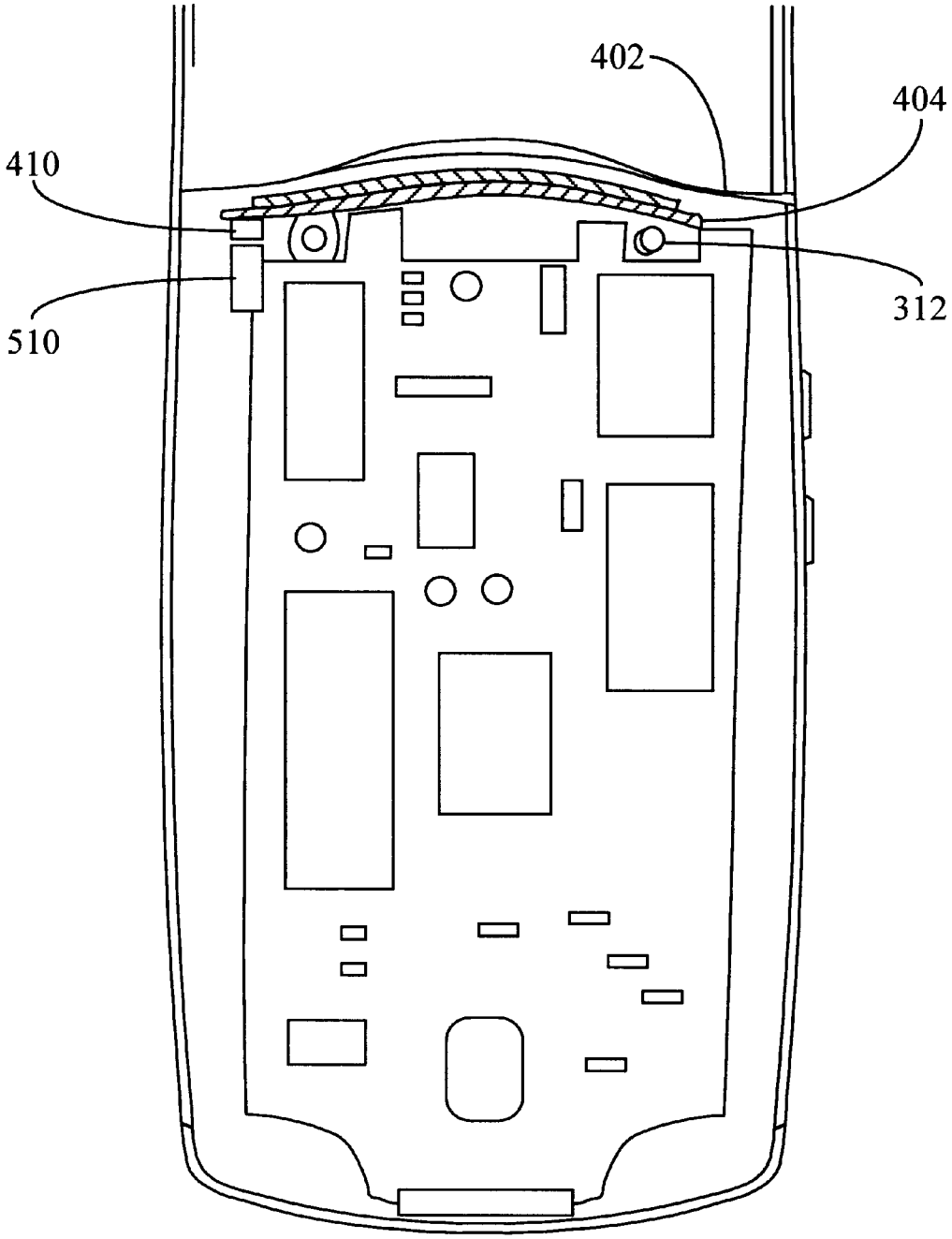

In FIGS. 5*a* and 5*b,* antennas 104 and 106 have been replaced by substrate antenna 400. Circuit board 302 is shown in FIG. 5*a* as comprising multiple layers of conductive and dielectric materials, such as copper and fiberglass, forming what is referred to in the art as a multi-layer board or a printed circuit board (PCB). This is illustrated as dielectric material layer 502 on top of or next to metallic conductor layer 504 next to dielectric material layer 506 next to or supporting metallic conductor layer 505. Conductive vias (not shown) are used to interconnect various conductors on different layers or levels with components on the outer surfaces Etched patterns on any given layer determine interconnection patterns for that layer. In this configuration, either layer 504 or 508 could form a ground layer or plane, as it is commonly referred to, for board 302, as would be known in the art.

Antenna 400 is mounted adjacent to circuit board 302, but is offset from the ground plane and placed with substrate 404 substantially perpendicular to the ground plane. This arrangement provides a very thin profile for antenna 400, allowing it to be placed in very confined spaces and near the surface of housing 102. For example, antenna 400 can be positioned between fastener or mounting posts and the side (top) of housing 102, something not achievable using conventional microstrip antenna designs.

As an option, such posts can now be used to automatically position and support antenna 400 without requiring additional support mechanisms or attachments. Some means of support is needed to position the substrate in place, and this provides for a very simple mounting mechanism, reducing labor costs for installation of the antenna and potentially allowing automated assembly. The nature of how the substrate can be mounted in place allows it to simply rest against the housing. The circuit board can also simply rest against the housing using the pressure fit of the display panel or the connector 118 which fit through holes or passages in the housing.

In the alternative, substrate 404 can be secured in place within the wireless device using small brackets, posts, bumps, ridges, slots, channels, support extrusions and protrusions, or the like formed in the material used to manufacture the walls of housing 102 can be used to rest the board against. That is, such supports are molded, or otherwise formed, in the wall of the device housing when manufactured, such as by injection molding. These support elements can then hold substrate 404 in position when inserted between them, or inside them, or using fasteners attached to them, during assembly of the phone. Ridges or tabs formed in the walls of the housing (or support posts) can "snap" around the edges of boards to assist in holding them in place.

Other means for mounting are the use of adhesives or tape to hold the substrate against a sidewall or some other portion or element the wireless device.

As seen in FIG. 5*b,* substrate 404 can be curved or otherwise bent to closely match the shape of the housing or to accommodate other elements, features, or components within the wireless device. The substrate can be manufactured in this shape or deformed during installation. Using a thin substrate allows the substrate to be flexed or bent when installed, and this can place a sort of tension or pressure by the substrate against adjacent surfaces. This pressure can act to generally secure the substrate in place without the need for screws or other types of fasteners.

However, those skilled in the art will readily recognize that there is no requirement to deform or curve the substrate either during manufacture or installation in order for the present invention to operate properly. A straight planar substrate functions very well as the base configuration. Other shapes have the advantage of accommodating various mounting conditions, but do not change the operation of the invention.

With everything resting in place, a back cover or plate for the housing is screwed, bolted, or otherwise fastened in place. This achieves a form of "capturing" of the antenna or substrate within the housing simply by installing the adjacent circuit board and covers or portions of the housing that are fastened in place. Additional fasteners or securing elements are not needed for the antenna in this approach. A set of tabs, or similar protrusions can be used to interface with the cover at some portions to decrease the number of screws needed to hold it in place.

Figure 6:
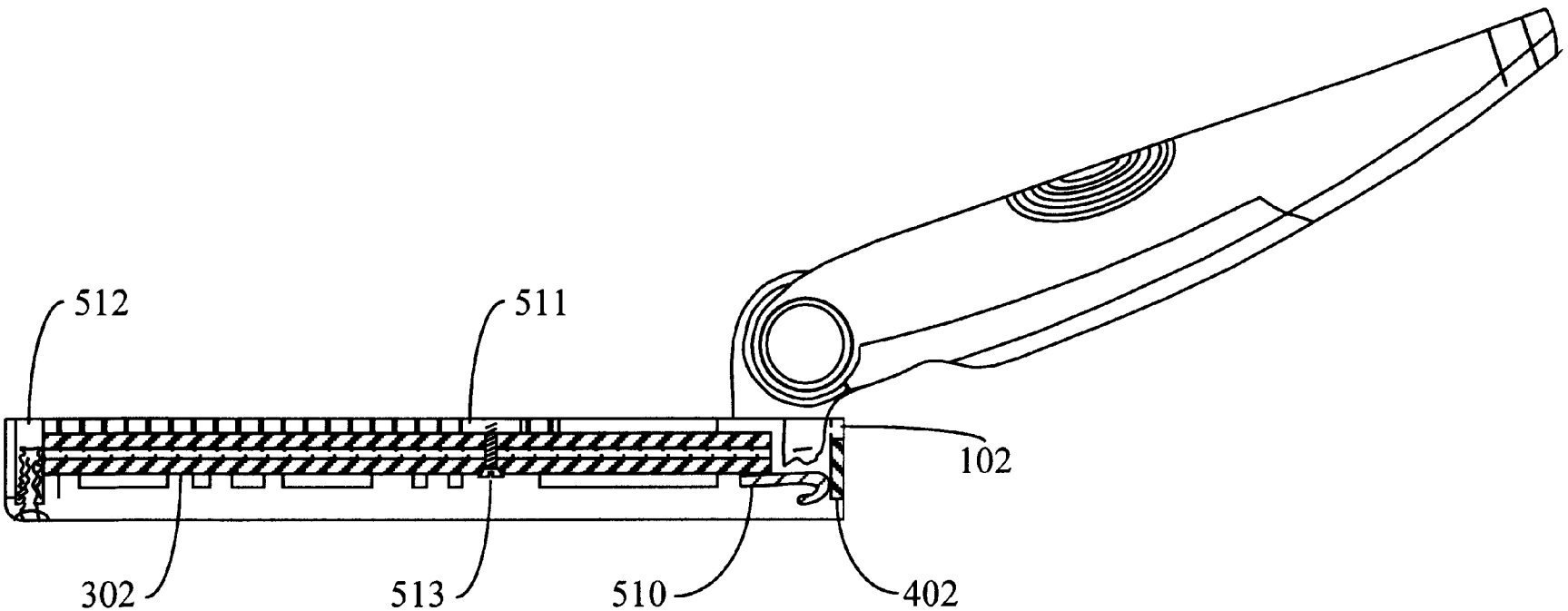
FIG. 6 illustrates a cross sectional side view of the phone of FIG. 5*a* with an alternative embodiment of the present invention.

Conductive pad 408 is positioned adjacent to and electrically coupled or connected to board 302 using a spring, spring contact or clip 510. Spring contact or clip 510 is mounted on circuit board 302 using well known techniques such as soldering or conductive adhesives. Clip 510 is electrically connected on one end to appropriate conductors or conductive vias to transfer signals to and from one or more desired transmit and receive circuits used within the wireless device, which are to be coupled to antenna 400. The other end of clip 510 is generally free floating and extends from circuit board 302 toward where antenna 400 is to be placed. More specifically, clip 510 is positioned adjacent to the end of trace 402 where contact pad 408 is located. As shown in the figures, clip 510 is bent in a circular fashion away from the antenna and then in an arch until it is directed back toward the antenna. This circular arch provides a more flexible and simple to work with structure. However, other types of clips, such as seen in FIG. 6, are also known to be useful, and the invention is not limited to this. Spring contact or clip 510 is typically manufactured from a metallic material such as copper or brass, but any deformable conductive material known for this type of application may be used subject to signal attenuation or other desired contact characteristics, as would be known in the art.

Because antenna 400 is not positioned over or parallel with and immediately adjacent to a ground plane, such as layer 504, the antenna has or maintains a sufficiently large radiation resistance. This means that it is possible to provide appropriate matching for antenna 400 without incurring significant losses, that is, the antenna has a good matching impedance. This efficiency is maintained even if antenna 400 is moved to various positions offset to one side of circuit board 302, that is, it is moved laterally but not closer to board 302. This antenna design acts as a very efficient means to excite the ground plane, without compromising performance.

The substrate is not required to be perpendicular to the ground plane but a major feature of the invention is the small size and an ability to use minimal space. If the substrate is placed in the same plane and parallel to the ground plane, it would clearly occupy more space between the housing and the ground plane. This is less desirable. However, that orientation of the substrate does not prevent the antenna from being operational. Conventional patch antennas must be used in this manner and it is one reason they consume too much space. The present invention differs in that it can use such a small amount of lateral space in the wireless device.

By locating the antenna adjacent to and above or beyond the edge of the ground plane relative to the housing, the antenna provides a very omnidirectional pattern, more so than a conventional whip antenna. This positioning of the antenna also means that the resulting radiation pattern is substantially vertically polarized as desired for most wireless communication devices.

The substrate is not positioned "over" or "under" the ground plane for the electronics in the wireless device, because in that position, as discussed earlier, the impedance would be adversely affected along with performance. It is important to not have the antenna over the ground plane. This can be expressed in several ways. For example, there is a volume or space positioned above the surfaces of the ground plane which occupies the entire ground plane up to its edges (bounded by edges). This volume is an exclusion zone or area for the substrate. Locating the trace within this volume implies being positioned over the ground plane. From an other point of view, any elevation or offset angle between the plane of the ground plane and the position of the substrate antenna, its plane, cannot be 90 degrees. In fact, it should be substantially less than 90 degrees to assure appropriate or sufficient separation from the ground plane.

Another way to look at the antenna, and therefore substrate, positioning is to look at the advantages created by this design. This antenna can be mounted between the ground plane and a sidewall (or top or bottom, depending on the point of view) near a top portion of the wireless device. In the case of the folding phone, the antenna can be mounted near the hinge or rotating or pivoting joint between the two folding portions. This provides a position for the antenna that is farther removed from the user, such as user's head, during use owing to the nature of how the phone unfolds, and that joint is positioned. This is a distinct advantage in terms of head absorption and the like. For a "bar" shaped phone or wireless device, the substrate antenna can be mounted near a top or side surface as desired.

The present invention is the first invention to have a configuration that allows use of these spaces or regions. The present invention is in this sense a new method of utilizing the space, volume or regions of the wireless device adjacent to the circuit board and next to the housing, offset from the ground plane. A new type of internal antenna mountable within a region immediately laterally adjacent to a ground plane.

An advantage of the invention is that it does not require removing part of the substrate either to be mounted or positioned in place. Large patch antennas or elements require so much real estate or area that they need part of the circuit board removed, or circuits moved, to have a place for mounting. Another aspect of such antennas is that they are generally mounted to be aligned within the plane of the ground plane. That is, the antenna radiators are formed in a planer configuration (even if they meander) and their -planar axis is aligned to that of the ground plane, which leads to excessive use of space by the antenna, defeating part of the object of using an internal antenna, loss of space.

It should be understood that a portion of trace 402 shown in FIGS. 4 and 5 is considered to be more sensitive to changes in effective resonant length. This portion is most likely to exhibit changes in antenna resonance from the presence of a wireless device users hand or head. There are three main energy losses impacting the operation of antenna 400 in a wireless device. These are impedance mismatch loss caused by dielectric loading of a user's hand, user head absorption, and user hand absorption. Such energy absorption or mismatch loss can degrade performance. For example, hand or head absorption can significantly attenuate signals being used by the wireless device, thus, degrading performance.

The portion of antenna 400 most sensitive to these effects is the open end, non-feed, and adjacent bent sections of trace 402. This portion of the antenna can be located or positioned within the phone housing such that a user's hand will make the least contact or maintain a significant spacing from the antenna. This antenna design allows the flexibility in placement within the wireless device to minimize hand absorption, and more importantly to decrease the mismatch loss that can be created by the presence of a hand or other items adjacent to an antenna (except when such a shift is desired).

Another aspect of the small antenna size and flexibility in placement is the impact it can have on energy levels present near a device user. The smaller size and flexible configuration of the antenna affects the placement of the antenna in the housing, which in turn can greatly impact radiation levels experienced at particular locations outside of the device.

To further assist in reducing the antenna size or in allowing flexible placement within housing 102, the antenna can also be formed by positioning or depositing conductive material on the housing or a surface within the wireless device. That is, for applications where there is a clear path along a housing sidewall, the trace can be deposited or formed right on the wall. This is shown in the cross sectional side view of FIG. 6. In FIG. 6, trace or traces 402 are disposed directly on the housing which acts as a support substrate. This provides the utmost in using a minimum amount of space.

Where the portion of the housing wall to be used is metal coated or is manufactured from a metallic or other electrically conductive material, an intermediate layer of insulating material can be used between the housing and trace 402. In this configuration a metallic layer having the desired trace configuration could be formed on a thin layer of material having an adhesive backing which allows easy placement in the wireless device by simple pressure against the side of the housing. This step could even be automated using "pick and place" machinery known in the art. The trace in this or any embodiment can use further coatings or such, as known in the art, for surface protection.

However, it will be clear to those skilled in the art, the relative positioning of the antenna or conductive material relative to the ground plane should be the same as discussed above, in terms of not being over the ground plane.

FIGS. 7*a*–7*h* illustrate several alternative embodiments for the traces used in forming the antenna of the present invention. In FIG. 7*a,* a trace 402 is shown as a single thin conductive strip that extends along the length of substrate 404 (not shown), and is connected to or formed with a rounded contact pad 408 on one end. In FIG. 7*b,* trace 402 is a single thin conductive strip connected to contact pad 408, and having an enlarged or rounded portion formed on the non-contact end. This trace has the appearance of a "dog bone". In FIG. 7*c,* trace 402 is a longer thin conductive strip connected to or formed with a more squared contact pad 408. Here, the strip extends along the length of substrate 404 and is then folded or bent near the far non-contact end, so that it is redirected back toward the contact pad. This allows the antenna to have a shorter overall length than that of the trace used to form a $\lambda/4$ length element. As stated below, it should be understood that a variety of patterns or shapes can be used in redirecting or folding the trace along different directions. For example, square corners, circular bands, or other shapes can be used for this function, without varying from the teachings of the invention. The trace is also wider in the folded back portion than in the other portion. The increased width, as in FIG. 4*b,* provides "top loading" or improved bandwidth for the antenna, which will be useful for some applications. However, this extra width is not required by the invention.

In FIG. 7*d,* trace 402 is again shown as a conductive strip connected to contact pad 408 which extends along the length of substrate 404. In this embodiment, the trace assumes a more complex shape following the edge of the substrate which has been manufactured with a tab or protrusion along one edge and a corresponding inset or depression on the opposing edge. The trace undergoes two angled turns before it reaches the far end of the substrate where it folds back toward the contact end. The last portion of the trace after it is folded is also slightly larger than the initial length of the trace.

The tab and other angles and depressions along the length of the substrate serve to interface with the sides or features of the wireless device housing and various support elements. That is, the edges of substrate 404 can be shaped in, or take on a variety of shapes, to fit within a housing. The edges can be shaped to mate with or be positioned around corresponding variations in the walls of the housing and to circumvent various bumps, extrusions, irregularities or known protrusions from surfaces of the housing walls, or to even leave gaps for wires, conductors and cables that need to be placed in the wireless device. The sides or edges of the substrate can use a variety of rounded, square or other shapes for this purpose. Such edges allow the antenna to be mounted in spaces heretofore unsuitable to microstrip antennas.

Furthermore, the shape of traces 402 or substrate antenna 400 can also vary in a three dimensional sense. That is, while traces are formed as generally planar surfaces, the substrate, or substrate surface supporting the trace, can be curved or bent to accommodate various mounting configurations. That is, the substrate can be manufactured as a curved or bent structure, variable surface, or simply deformed during installation due to its generally thin but strong nature. This is shown in FIG. 7*e* where a top edge view of the substrate, transverse to the length, shows substrate 404 curved. It will be clear to those skilled in the art that various curves or bends can be used in this dimension. For example, the substrate surface could form a "meandered" pattern of some sort as well.

A preferred embodiment of the present invention which was constructed and tested is shown in the side and front plan views of FIGS. 7*f*–7*h*. Here, substrate 402 was made approximately 52 millimeters in overall length with a trace width of about 1 mm. Where the trace widens near the end of folded back portion 702, the width approached 1.5 mm. Contact pads 408 and 410 were both made about 6.75 mm square with a series of appropriate conductive vias extending through the substrate to connect the two. A fiberglass substrate was used which was about 1 mm in thickness, and the traces and pads were about 0.01 mm thick. Note the space 704 between the end of the trace where it is folded back and the edge of the substrate. This optional space or gap with the edge serves to set the trace back and further decrease the impact of a hand coming near, or into contact with, the edge of the antenna.

It will be clear to those skilled in the art that a variety of shapes, such as, but not limited to, circular, elliptical, parabolic, angular, and squared C-, L-, or V-shaped folds, joints, and edges can be used for the traces and substrate. The width of the conductors can be changed along the length such that they taper, curve, or stepwise change to a narrower or wider width toward the outer end (non-feed portion). As will be clearly understood by those skilled in the art, several of these effects or shapes can be combined in a single antenna structure. For example, an angled stepped strip which is then curved along another dimension is possible.

Figure 5C:
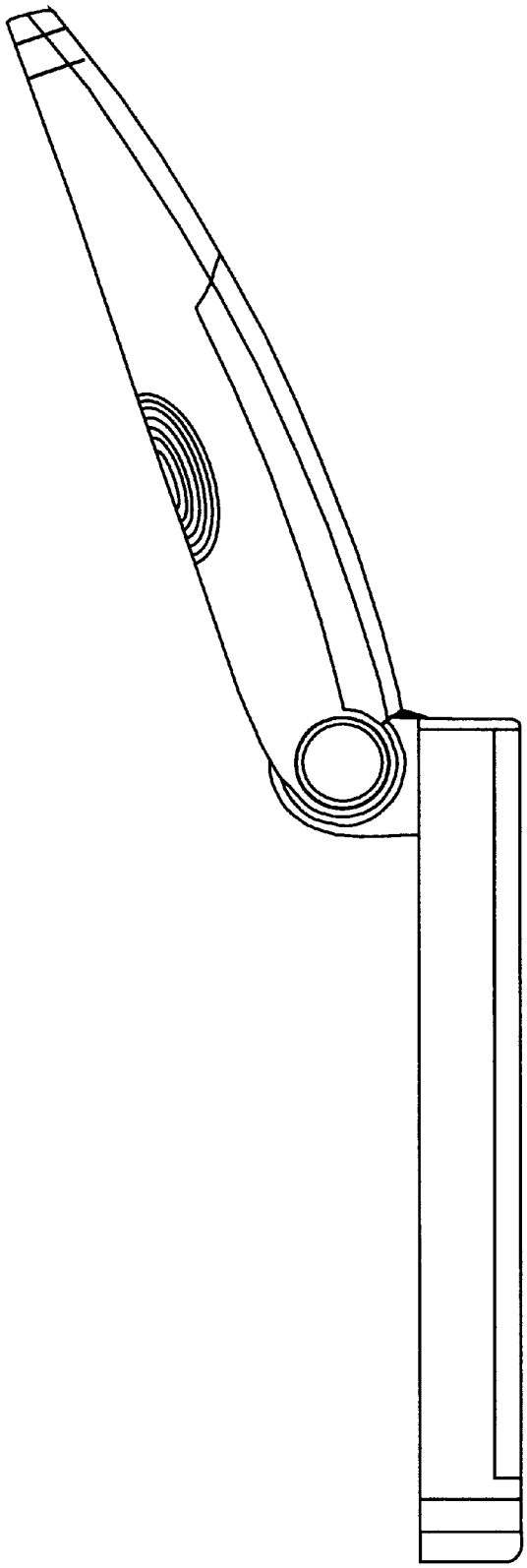
FIG. 5*c* illustrates a side plan view of the phone of FIG. 1*b* using the present invention.

The result of removing both whip antenna 104 and helical antenna 106 is readily apparent in the side plan view of FIG. 5*c* which shows the phone of FIG. 1*b* using the present invention.

The previous description of the preferred embodiments is provided to enable any person skilled in the art to make or use the present invention. The various modifications to these embodiments will be readily apparent to those skilled in the art, such as the type of wireless device in which used, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What we claim as our invention is:

1. A substrate antenna for use in wireless communication devices having a planar ground plane for circuitry incorporated therein, comprising:

a non-conductive support substrate having a preselected thickness and length being a separate structure from said ground plane;

an antenna radiator element in the form of a conductive trace formed on said support substrate, said conductive trace having a feed end and an open end, and having a length selected such that it acts as an active radiator of electromagnetic energy at at least one preselected frequency, said length of said conductive trace being approximately one-quarter wavelength of said electromagnetic energy; and said support substrate is disposed within said wireless device adjacent to and beyond an edge of said planar ground plane.

2. The substrate antenna of claim 1, wherein said trace is formed by depositing metallic material on dielectric material.

3. The substrate antenna of claim 1, further comprising a conductive pad coupled to said feed end of said trace, configured for transferring signals between said radiator and other circuitry.

4. The substrate antenna of claim 3, wherein said conductive pad interfaces with spring type signal feeds.

5. The substrate antenna of claim 1, wherein the length and width of said trace is sized so that said substrate antenna is capable of receiving and transmitting signals having a frequency range of 824–894 MHz.

6. The substrate antenna of claim 1, wherein the length and width of said trace is sized so that said substrate antenna is capable of receiving and transmitting signals having a frequency range of 1.85–1.99 GHz.

7. The substrate antenna of claim 1, wherein said substrate is positioned adjacent to an edge of said ground plane and has a central planar axis which is offset from the plane by less than 90 degrees.

8. The substrate antenna of claim 1, wherein said substrate has a central planar axis which is positioned parallel to an edge of said ground plane.

9. The substrate antenna of claim 8, wherein said substrate resides in a plane which is positioned substantially perpendicular to the plane of said ground plane.

10. The substrate antenna of claim 1, wherein said substrate is not positioned either directly above or below a planar area occupied by the ground plane.

11. The substrate antenna of claim 1, wherein said substrate is disposed between an edge of said ground plane and a housing wall for said wireless device.

12. The substrate antenna of claim 1, wherein said radiator extends along a linear path between first and second ends of said substrate.

13. The substrate antenna of claim 12, wherein said radiator further bends adjacent one end of said substrate and extends back toward the opposite end.

14. The substrate antenna of claim 1, wherein said support substrate comprises an integral part of a housing for said wireless device.

15. The substrate antenna of claim 1, wherein said support substrate comprises a support element secured to a preselected location on a housing for said wireless device.

* * * * *